US010697108B2

(12) United States Patent
Hoppe et al.

(10) Patent No.: US 10,697,108 B2
(45) Date of Patent: Jun. 30, 2020

(54) LAUNDRY WASHING MACHINE WITH DYNAMIC DAMPING FORCE OPTIMIZATION

(71) Applicant: Midea Group Co., Ltd., Beijiao, Shunde, Foshan (CN)

(72) Inventors: Christopher G. Hoppe, Louisville, KY (US); Phillip C. Hombroek, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 0 days.

(21) Appl. No.: 16/356,553

(22) Filed: Mar. 18, 2019

(65) Prior Publication Data

US 2019/0211491 A1 Jul. 11, 2019

Related U.S. Application Data

(62) Division of application No. 15/273,614, filed on Sep. 22, 2016, now Pat. No. 10,266,982.

(51) Int. Cl.
*D06F 33/40* (2020.01)
*D06F 37/26* (2006.01)
(Continued)

(52) U.S. Cl.
CPC ..... *D06F 37/268* (2013.01); *D06F 34/22* (2020.02); *D06F 37/203* (2013.01); *D06F 33/00* (2013.01);
(Continued)

(58) Field of Classification Search
CPC ..... D06F 18/00; D06F 25/00; D06F 33/00; D06F 33/30–76; D06F 34/00–34;
(Continued)

(56) References Cited

U.S. PATENT DOCUMENTS 5,218,731 A 6/1993 Broadbent
5,720,066 A 2/1998 Kim
(Continued)

FOREIGN PATENT DOCUMENTS

CN 101878335 A 11/2010
CN 103628277 A 3/2014
(Continued)

OTHER PUBLICATIONS

International Search Report and Written Opinion issued in Application No. PCT/CN2017/101433 dated Dec. 1, 2017.
(Continued)

*Primary Examiner* — David G Cormier
(74) *Attorney, Agent, or Firm* — Middleton Reutlinger

(57) ABSTRACT

A laundry washing machine and method implement dynamic damping force optimization during a wash cycle to optimize a force-generating operation such as a spin operation performed during the wash cycle. The dynamic damping force optimization may utilize inputs from a suspension force sensor in combination with an accelerometer to dynamically determine a damping capability for a suspension of a laundry washing machine such that damping in the suspension system may be maintained within the damping capability of the suspension system to balance operation performance against the generation of undesirable forces and vibrations.

12 Claims, 4 Drawing Sheets

(51) Int. Cl.

| | |
|---|---|
| ***D06F 37/20*** | (2006.01) |
| ***D06F 34/22*** | (2020.01) |
| *D06F 33/00* | (2020.01) |
| *D06F 34/18* | (2020.01) |

(52) U.S. Cl.
CPC ..... *D06F 34/18* (2020.02); *D06F 2202/06* (2013.01); *D06F 2202/10* (2013.01); *D06F 2202/12* (2013.01); *D06F 2204/065* (2013.01); *D06F 2204/088* (2013.01)

(58) Field of Classification Search
CPC ..... D06F 35/00; D06F 35/001; D06F 35/002; D06F 35/003; D06F 35/004; D06F 35/005; D06F 35/006; D06F 35/007; D06F 35/008; D06F 37/00; D06F 37/20; D06F 37/203; D06F 37/22; D06F 37/225; D06F 37/24; D06F 37/245; D06F 37/268; D06F 37/30; D06F 37/304; D06F 37/306; D06F 37/42; D06F 39/00; D06F 39/006; D06F 39/022; D06F 39/04; D06F 39/06; D06F 58/00; D06F 58/02; D06F 58/04; D06F 58/203; D06F 58/30; D06F 58/32–52; D06F 2101/00–20; D06F 2103/00–70; D06F 2105/00–62; D06F 2202/00–12; D06F 2204/00–10; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS

| | | | |
|---|---|---|---|
| 5,930,855 | A | 8/1999 | Vande Haar et al. |
| 6,397,643 | B1 | 6/2002 | Chang et al. |
| 6,460,381 | B1 | 10/2002 | Yoshida et al. |
| 7,409,738 | B2 | 8/2008 | Borras et al. |
| 7,536,881 | B2 | 5/2009 | Lorenz et al. |
| 7,581,272 | B2 | 9/2009 | Xie et al. |
| 8,695,381 | B2 | 4/2014 | Moore |
| 8,713,976 | B2 | 5/2014 | Hoppe et al. |
| 2009/0249560 | A1 | 10/2009 | Gaulter et al. |
| 2009/0266113 | A1 | 10/2009 | Musser et al. |
| 2009/0288260 | A1 | 11/2009 | Jurmann |
| 2010/0154130 | A1 | 6/2010 | Han et al. |
| 2010/0293722 | A1 | 11/2010 | Munhoz et al. |
| 2011/0067186 | A1 | 3/2011 | Johansson |
| 2012/0089258 | A1 | 4/2012 | Wong et al. |
| 2015/0191859 | A1 | 7/2015 | Webster et al. |

FOREIGN PATENT DOCUMENTS

| | | | |
|---|---|---|---|
| CN | 104928884 | A | 9/2015 |
| CN | 205347797 | U | 6/2016 |
| EP | 0294014 | A1 | 12/1988 |
| EP | 1167609 | B1 | 9/2004 |

OTHER PUBLICATIONS

Memsic, Washing Machine Vibration, Powerful Sensing Solutions, 2016, US.
U.S. Patent Office; Office Action issued in U.S. Appl. No. 15/273,614, dated Aug. 10, 2018.
U.S. Patent Office; Notice of Allowance issued in U.S. Appl. No. 15/273,614 dated Dec. 12, 2018.

LAUNDRY WASHING MACHINE WITH DYNAMIC DAMPING FORCE OPTIMIZATION

BACKGROUND

Laundry washing machines are used in many single-family and multi-family residential applications to clean clothes and other fabric items. During different phases of a wash cycle, a load of items will generally be subject to different operations that can introduce forces and/or vibrations not only to the load but also to the machine itself and/or to its surroundings. During a wash phase, for example, a wash tub may be filled with water and an agitator or impeller may be used to agitate the water and the load. During a rinse phase, a wash basket within the wash tub may be spun and/or the agitator/impeller may again be used to assist with rinsing detergent and soil from the load. In addition, during a spin phase, the wash basket is generally spun at a relatively high speed to extract water from the load.

Given that the contents of a wash tub, as well as the moving components within a laundry washing machine, have a mass, movement of these bodies can introduce undesirable forces, typically perceived as vibrations, not only to the fixed components of the machine but also to the floor or other surrounding structure in a dwelling. In addition, even within a given wash cycle, this mass can vary considerably as water is added to or removed from the wash tub.

In some laundry washing machine designs, a suspension system is used to attempt to isolate a floating or suspended portion of the machine (e.g., the wash tub and the movable and other force-generating components) from the non-suspended components (e.g., the cabinet or housing) and the surrounding environment, and thereby reduce the amount of forces and vibrations communicated to the non-suspended components and the surrounding environment. In a top load laundry washing machine, for example, a wash tub may be suspended on a set of support rods that are secured at one end to the cabinet or housing of the machine and secured at the other end to respective dampers secured in turn to the wash tub, e.g., proximate a bottom portion of the wash tub. The dampers may include springs and/or air or friction-based damping mechanisms, and through the suspension of the wash tub and the damping effect of the dampers, the forces and vibrations generated during a wash cycle can be substantially attenuated.

Nonetheless, the range of forces that may be generated during a wash cycle can vary considerably and can vary substantially even for different wash cycles due to differences in the sizes of the load and the amount of water used. Furthermore, excessive forces, e.g., due to out of balance loads, can overcome the damping effect of the suspension system and lead to undesirable levels of vibration as well as in some instances undesirable noises such as cabinet banging that result from excessive displacement of the suspended portion. As a result, many conventional washing machines make a number of tradeoffs, such as tuning suspension systems for "average" loads and limiting operations such as spinning the wash basket during the spin phase to speeds that are below the speeds that might otherwise be used for certain loads to ensure that excessive vibrations and/or noises are not encountered in other loads. Furthermore, it has been found that suspension systems can wear over time and as a result the damping effect of such systems can also change over time.

SUMMARY

The herein-described embodiments address these and other problems associated with the art by providing a laundry washing machine and method that implement dynamic damping force optimization during a wash cycle to optimize a force-generating operation such as a spin operation performed during the wash cycle. In some embodiments, the dynamic damping force optimization may utilize inputs from a suspension force sensor in combination with an accelerometer to dynamically determine a damping capability for a suspension of a laundry washing machine such that damping in the suspension system may be maintained within the damping capability of the suspension system to balance operation performance against the generation of undesirable forces and vibrations.

Therefore, consistent with some aspects of the invention, a laundry washing machine may include a wash tub disposed within a housing, a suspension system supporting the wash tub within the housing and configured to damp forces generated during one or more force-generating operations during a wash cycle, a suspension force sensor coupled to the suspension system and configured to sense a force applied to the suspension system during the one or more force-generating operations, an accelerometer configured to sense acceleration of the wash tub during the one or more force-generating operations, and a controller coupled to the suspension force sensor and the accelerometer and configured to dynamically determine a damping capability of the suspension system and control the one or more force-generating operations to maintain damping in the suspension system within the dynamically determined damping capability of the suspension system.

In some embodiments, the suspension force sensor includes a load cell configured to sense a tension force in the suspension system, and in some embodiments, the wash tub is generally vertically-oriented, the suspension system includes a plurality of support members supporting the wash tub, and the load cell is configured to sense a tension force in at least one of the plurality of support members. Further, in some embodiments, each support member includes a support rod, and in some embodiments, the load cell is coupled intermediate first and second ends of a first support rod among the plurality of support rods.

In some embodiments, the wash tub is generally horizontally-oriented, and the suspension force sensor includes a load cell configured to sense a compression force in the suspension system, and in some embodiments, the accelerometer is coupled to the wash tub. Further, in some embodiments, the accelerometer is a multi-axis accelerometer configured to sense acceleration in two or more directions, and in some embodiments, the controller is configured to dynamically determine the damping capability using the sensed force from the suspension force sensor and the sensed acceleration from the accelerometer.

In addition, in some embodiments, the controller is configured to dynamically determine the damping capability based upon a damping ratio between a suspension coefficient and a critical damping coefficient, where the suspension coefficient is based upon a coefficient of friction for a damper in the suspension system, and the critical damping coefficient is based upon the suspension coefficient. In some embodiments, the one or more force-generating operations includes a spin operation, and the controller is further configured to dynamically vary a spin speed during the spin operation based upon the determined damping capability, while in some embodiments, the controller is further configured to detect resonant oscillation and dynamically vary the spin speed to avoid the resonant oscillation.

Other embodiments may include a method of operating a laundry washing machine of the type including a wash tub disposed within a housing and a suspension system supporting the wash tub within the housing and configured to damp forces generated during one or more force-generating operations during a wash cycle. The method may include sensing a force applied to the suspension system during the one or more force-generating operations with a suspension force sensor coupled to the suspension system, sensing acceleration of the wash tub during the one or more force-generating operations with an accelerometer, and using the sensed force and acceleration, dynamically determining a damping capability of the suspension system and controlling the one or more force-generating operations to maintain damping in the suspension system within the dynamically determined damping capability of the suspension system.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
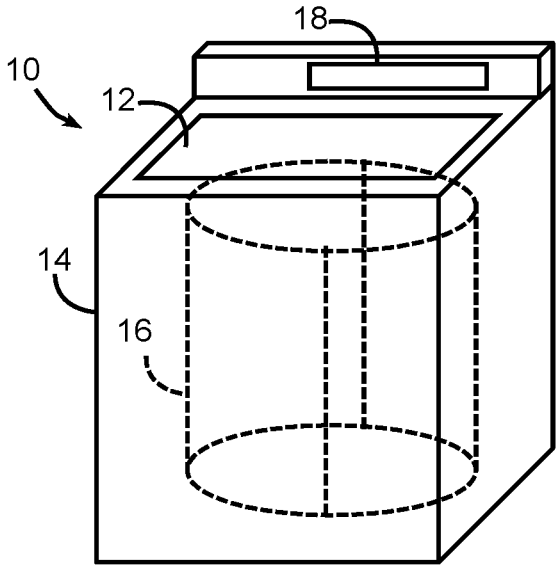
FIG. 1 is a perspective view of a top-load laundry washing machine consistent with some embodiments of the invention.

Embodiments consistent with the invention may be used to optimize the performance of various types of force-generating operations in a laundry washing machine to maintain damping in a suspension system within a dynamically-determined damping capability for the suspension system. In this regard, a force-generating operation may include various types of operations performed during a wash cycle and capable of generating forces. The hereinafter-described embodiments, for example, focus on spin operations performed during a spin phase of a wash cycle, where a wash basket within a wash tub is spun at a high rate of speed to extract water from a load. It will be appreciated, however, that other operations during a wash cycle may generate forces, e.g., as a result of agitating a load using an agitator and/or spinning a wash basket for other purposes and/or during other phases of a wash cycle, and that such operations may also be controlled in the manner disclosed herein in some embodiments of the invention.

A damping capability may be considered to represent a numerical calculation representative of the relative ability of the suspension to damp forces under current conditions, i.e., a level at which the suspension system is capable of damping forces generated during force-generating operations to an acceptable amount for a given application. Thus, by maintaining damping in a suspension system within a damping capability, the damping effect of the suspension system is not overwhelmed and the forces or vibrations conveyed to the non-suspended portion of the washing machine and/or the surrounding environment are maintained within acceptable levels.

The damping capability may be considered to be dynamically determined insofar as the damping capability may be calculated during a wash cycle or otherwise determined based upon measured characteristics of the suspension system, as it has been found that the damping capability of a suspension system is generally not a static characteristic and can vary, for example, as a result of wear of suspension system components over time. The damping capability may in some embodiments be defined in specific units, while in other embodiments the damping capability may be dimensionless. Further, a damping capability in some embodiments may be implemented as a threshold against which a measured damping force is compared, while in other embodiments a damping capability may be defined as a range, a series of thresholds, or based on a hysteresis loop of the damper and the superelastic behavior of the damper material as thermal conditions change.

In the embodiments discussed hereinafter, for example, dynamic damping force optimization may dynamically determine a damping capability of a suspension system, i.e., a system in a washing machine that supports the wash tub, and in some cases, additional force-generating components, and that generally includes an ability to damp forces generated by the force-generating components during a wash cycle, and may control one or more force-generating operations to maintain damping in the suspension system below the dynamically determined damping capability. The optimization may be based upon inputs from one or more suspension force sensors and one or more accelerometers. A suspension force sensor may be used to sense a force applied to a suspension system of a laundry washing machine. The applied force, in some embodiments, may be applied through one or support members, e.g., support rods, that are used to support and suspend a wash tub and other suspended components in a washing machine. An accelerometer may be used to sense acceleration of the wash tub during force-generating operations, and as will become more apparent below, may be coupled to a wash tub, to a portion of the suspension system, or any other suspended component of a washing machine that is subject to acceleration in one or more directions as a result of force-generating operations.

Numerous variations and modifications will be apparent to one of ordinary skill in the art, as will become apparent from the description below. Therefore, the invention is not limited to the specific implementations discussed herein.

Turning now to the drawings, wherein like numbers denote like parts throughout the several views, FIG. 1 illustrates an example laundry washing machine 10 in which the various technologies and techniques described herein may be implemented. Laundry washing machine 10 is a top-load washing machine, and as such includes a top-mounted door 12 in a cabinet or housing 14 that provides access to a vertically-oriented wash tub 16 housed within the cabinet or housing 14. Door 12 is generally hinged along a side or rear edge and is pivotable between the closed position illustrated in FIG. 1 and an opened position (not shown). When door 12 is in the opened position, clothes and other washable items may be inserted into and removed from wash tub 16 through an opening in the top of cabinet or housing 14. Control over washing machine 10 by a user is generally managed through a control panel 18 disposed on a backsplash and implementing a user interface for the washing machine, and it will be appreciated that in different washing machine designs, control panel 18 may include various types of input and/or output devices, including various knobs, buttons, lights, switches, textual and/or graphical displays, touch screens, etc. through which a user may configure one or more settings and start and stop a wash cycle.

Figure 2:
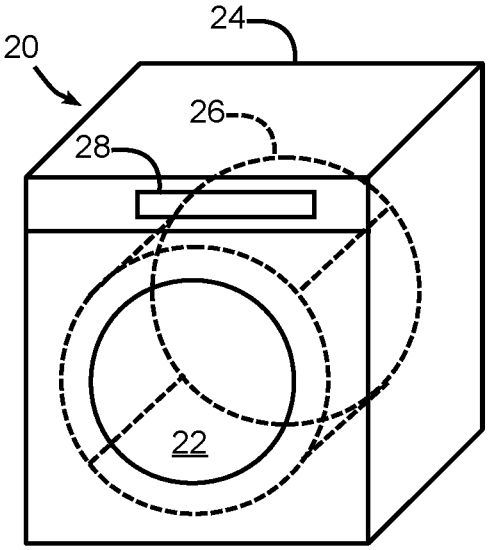
FIG. 2 is a perspective view of a front-load laundry washing machine consistent with some embodiments of the invention.

The embodiments discussed hereinafter will focus on the implementation of the hereinafter-described techniques within a top-load residential laundry washing machine such as laundry washing machine 10, such as the type that may be used in single-family or multi-family dwellings, or in other similar applications. However, it will be appreciated that the herein-described techniques may also be used in connection with other types of laundry washing machines in some embodiments. For example, the herein-described techniques may be used in commercial applications in some embodiments. Moreover, the herein-described techniques may be used in connection with other laundry washing machine configurations. FIG. 2, for example, illustrates a front-load laundry washing machine 20 that includes a front-mounted door 22 in a cabinet or housing 24 that provides access to a horizontally-oriented wash tub 26 housed within the cabinet or housing 24, and that has a control panel 28 positioned towards the front of the machine rather than the rear of the machine as is typically the case with a top-load laundry washing machine. Implementation of the herein-described techniques selection within a front-load laundry washing machine would be well within the abilities of one of ordinary skill in the art having the benefit of the instant disclosure, so the invention is not limited to the top-load implementation discussed further herein.

Figure 3:
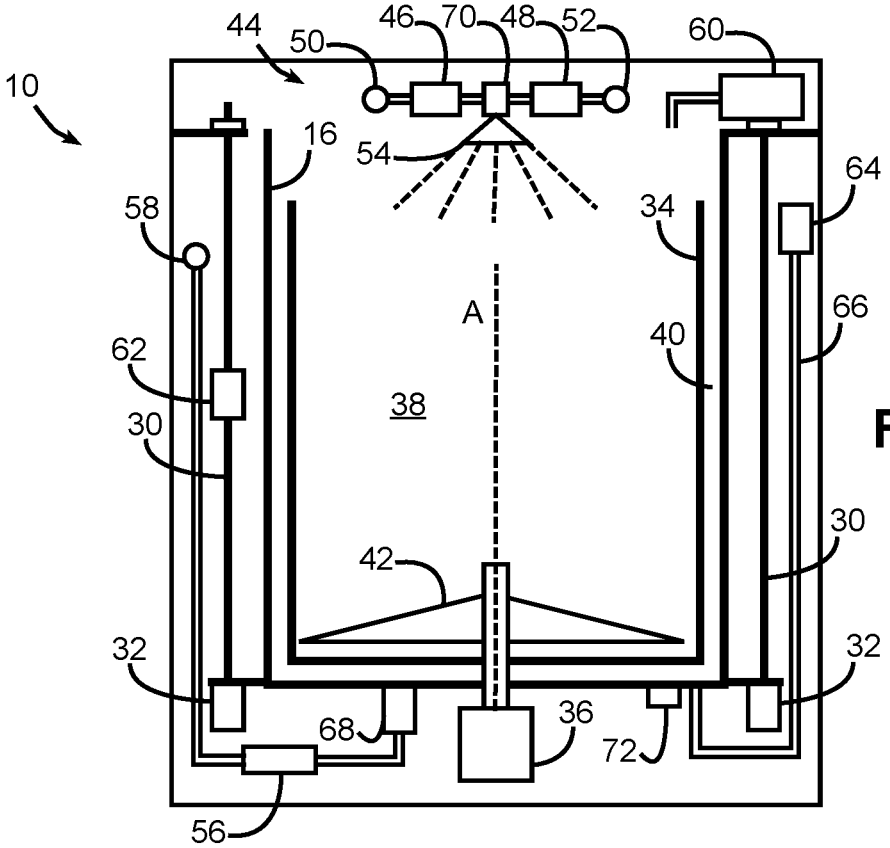
FIG. 3 is a functional vertical section of the laundry washing machine of FIG. 1.

FIG. 3 functionally illustrates a number of components in laundry washing machine 10 as is typical of many washing machine designs. For example, wash tub 16 may be vertically oriented, generally cylindrical in shape, opened to the top and capable of retaining water and/or wash liquor dispensed into the washing machine. Wash tub 16 may be supported by a suspension system such as a set of support rods 30 with corresponding vibration damper cylinders 32. In some embodiments, the support rods may be integrated with damper cylinders 32.

Disposed within wash tub 16 is a wash basket 34 that is rotatable about a generally vertical axis A by a drive system 36. Wash basket 34 is generally perforated or otherwise provides fluid communication between an interior 38 of the wash basket 34 and a space 40 between wash basket 34 and wash tub 16. Drive system 36 may include, for example, an electric motor and a transmission and/or clutch for selectively rotating the wash basket 34. In some embodiments, drive system 36 may be a direct drive system, whereas in other embodiments, a belt or chain drive system may be used.

In addition, in some embodiments an agitator 42 such as an impeller, auger or other agitation element may be disposed in the interior 38 of wash basket 34 to agitate items within wash basket 34 during a washing operation. Agitator 42 may be driven by drive system 36, e.g., for rotation about the same axis as wash basket 34, and a transmission and/or clutch within drive system 36 may be used to selectively rotate agitator 42. In other embodiments, separate drive systems may be used to rotate wash basket 34 and agitator 42.

A water inlet 44 may be provided to dispense water into wash tub 16. In some embodiments, for example, hot and cold valves 46, 48 may be coupled to external hot and cold water supplies through hot and cold inlets 50, 52, and may output to one or more nozzles 54 to dispense water of varying temperatures into wash tub 16. In addition, a pump system 56, e.g., including a pump and an electric motor, may be coupled between a low point, bottom or sump in wash tub 16 and an outlet 58 to discharge greywater from wash tub 16.

In some embodiments, laundry washing machine 10 may also include a dispensing system 60 configured to dispense detergent, fabric softener and/or other wash-related products into wash tub 16. Dispensing system 60 may include one or more dispensers, and may be configured in some embodiments as automated dispensers that dispense controlled amounts of wash-related products, e.g., as may be stored in a reservoir (not shown) in laundry washing machine 10. In other embodiments, dispensing system 60 may be used to time the dispensing of wash-related products that have been manually placed in one or more reservoirs in the machine immediately prior to initiating a wash cycle. Dispensing system 60 may also, in some embodiments, receive and mix water with wash-related products to form one or more wash liquors that are dispensed into wash tub 16. In still other embodiments, no dispensing system may be provided, and a user may simply add wash-related products directly to the wash tub prior to initiating a wash cycle.

It will be appreciated that the particular components and configuration illustrated in FIG. 3 is typical of a number of common laundry washing machine designs. Nonetheless, a wide variety of other components and configurations are used in other laundry washing machine designs, and it will be appreciated that the herein-described functionality generally may be implemented in connection with these other designs, so the invention is not limited to the particular components and configuration illustrated in FIG. 3.

Further, laundry washing machine 10 may also include various sensors for use in at least partially automating a wash cycle, e.g., one or more of a weight sensor, a fluid level sensor, a fluid property sensor and a flow sensor. It will be appreciated, however, that some or all of these sensors may be omitted in some embodiments.

A weight sensor may be used to generate a signal that varies based in part on the mass or weight of the contents of wash tub 16. In the illustrated embodiment, for example, a weight sensor may be implemented in laundry washing machine 10 using one or more load cells 62 that support wash tub 16 on one or more corresponding support rods 30. Each load cell 62 may be an electro-mechanical sensor that outputs a signal that varies with a displacement based on load or weight, and thus outputs a signal that varies with the weight of the contents of wash tub 16. Multiple load cells 62 may be used in some embodiments, while in other embodiments, other types of transducers or sensors that generate a signal that varies with applied force, e.g., strain gauges, may be used. Furthermore, while load cells 62 are illustrated as supporting wash tub 16 on support rods 30, the load cells, or other appropriate transducers or sensors, may be positioned elsewhere in a laundry washing machine to generate one or more signals that vary in response to the weight of the contents of wash tub 16. In some embodiments, for example, transducers may be used to support an entire load washing machine, e.g., one or more feet of a machine. Other types and/or locations of transducers suitable for generating a signal that varies with the weight of the contents of a wash tub will be apparent to one of ordinary skill in the art having the benefit of the instant disclosure.

A fluid level sensor may be used to generate a signal that varies with the level or height of fluid in wash tub 16. In the illustrated embodiment, for example, a fluid level sensor may be implemented using a pressure sensor 64 in fluid communication with a low point, bottom or sump of wash tub 16 through a tube 66 such that a pressure sensed by pressure sensor 64 varies with the level of fluid within the wash tub, as it will be understood that the addition of fluid to the wash tub will generate a hydrostatic pressure within the tube that varies with the level of fluid in the wash tub, and that may be sensed, for example, with a piezoelectric or other transducer disposed on a diaphragm or other movable element. It will be appreciated that a wide variety of pressure sensors may be used to provide fluid level sensing, including, among others, combinations of pressure switches that trigger at different pressures. It will also be appreciated that fluid level in the wash tub may also be sensed using various non-pressure based sensors, e.g., optical sensors, laser sensors, etc.

A fluid property sensor, e.g., a turbidity sensor 68, may be used in some embodiments to measure the turbidity or clarity of the fluid in wash tub 16, e.g., to sense the presence or relative amount of various wash-related products such as detergents or fabric softeners and/or to sense the presence or relative amount of soil in the fluid. Further, in some embodiments, turbidity sensor 68 may also measure other properties of the fluid in wash tub 16, e.g., conductivity and/or temperature. In other embodiments, separate sensors may be used to measure turbidity, conductivity and/or temperature, and further, other sensors may be incorporated to measure additional fluid properties. In other embodiments, no turbidity sensor may be used.

A flow sensor 70, e.g., one or more flowmeters, may be used to sense an amount of water dispensed into wash tub 16. In other embodiments, however, no flow sensor may be used. Instead, water inlet 44 may be configured with a static and regulated flow rate such that the amount of water dispensed is a product of the flow rate and the amount of time the water is dispensed. Therefore, in some embodiments, a timer may be used to determine the amount of water dispensed into wash tub 16.

In addition, for the purpose of dynamic damping force optimization as discussed herein, laundry washing machine 10 may additionally include at least one suspension force sensor (e.g., load cell 62) and at least one accelerometer 72 respectively configured to sense force in a suspension system and acceleration of a body (e.g., the tub) supported by the suspension system.

In the illustrated embodiment, for example, a tensioned suspension force sensor may be used and implemented using load cell 62 coupled in a tensioned arrangement to a support rod 30 intermediate the mountings of the support rod 30 to the housing 14 and tub 16. In addition, in this configuration, load cell 62 may also be used as a weight sensor for the various purposes mentioned above, although it will be appreciated that weight sensing may be omitted in some embodiments, as well as that separate sensors may be used for weight sensing and suspension force sensing in other embodiments.

It will further be appreciated that a suspension force sensor may be implemented using multiple load cells, e.g., coupled to multiple support rods, and that other types of transducers or sensors that generate a signal that varies with applied force, e.g., strain gauges, may be used. Furthermore, while load cell 62 is illustrated as coupled intermediate support rod 30 in a tensioned arrangement, it will be appreciated that other configurations suitable for sensing applied force within a suspension system may be used, e.g., using load cells or other transducers or sensors coupled in tension or in compression at different points along a support rod, using load cells or other transducers or sensors coupled in tension or in compression at other locations in a suspension system such as where a support rod is coupled to housing 14 or tub 16.

Figure 4:
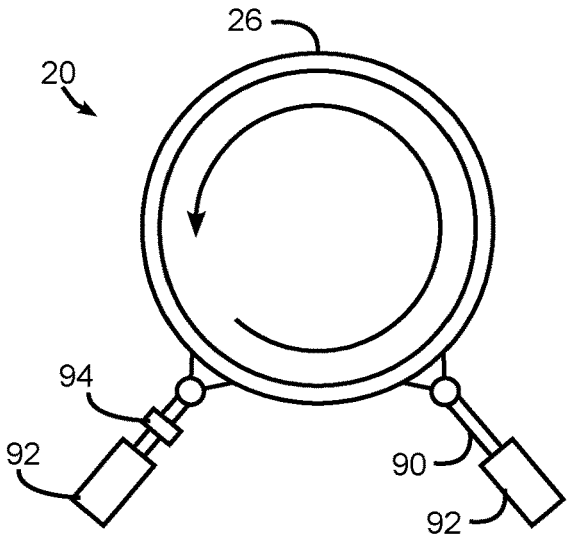
FIG. 4 is a functional vertical section of the laundry washing machine of FIG. 2.

For example, as illustrated in FIG. 4, a suspension force sensor may be implemented in a front load washer design such as front load washer 20 of FIG. 2, in which tub 26 may be suspended on one or more absorber assemblies 90 including damper cylinders 92, which may, in some embodiments, include a friction piston with integrated spring. One or more of the assemblies 90 may include a load cell 94 coupled to sense compression in the respective assembly.

Returning to FIG. 3, accelerometer 72 may be coupled to the bottom of tub 16 or to another location suitable for sensing acceleration of a body suspended or supported by the suspension system, e.g., tub 16. In the illustrated embodiment, accelerometer 72 may be a multi-axis accelerometer capable of sensing acceleration in two or more directions, and may be implemented using any number of different available sensor designs, e.g., piezoelectric, piezoresistive, capacitive, micromechanical, etc. Further, accelerometer 72 is illustrated as mounted to the underside of tub 16, although it will be appreciated that an accelerometer may be positioned at different locations suitable for sensing acceleration of a suspended body in other embodiments.

Figure 5:
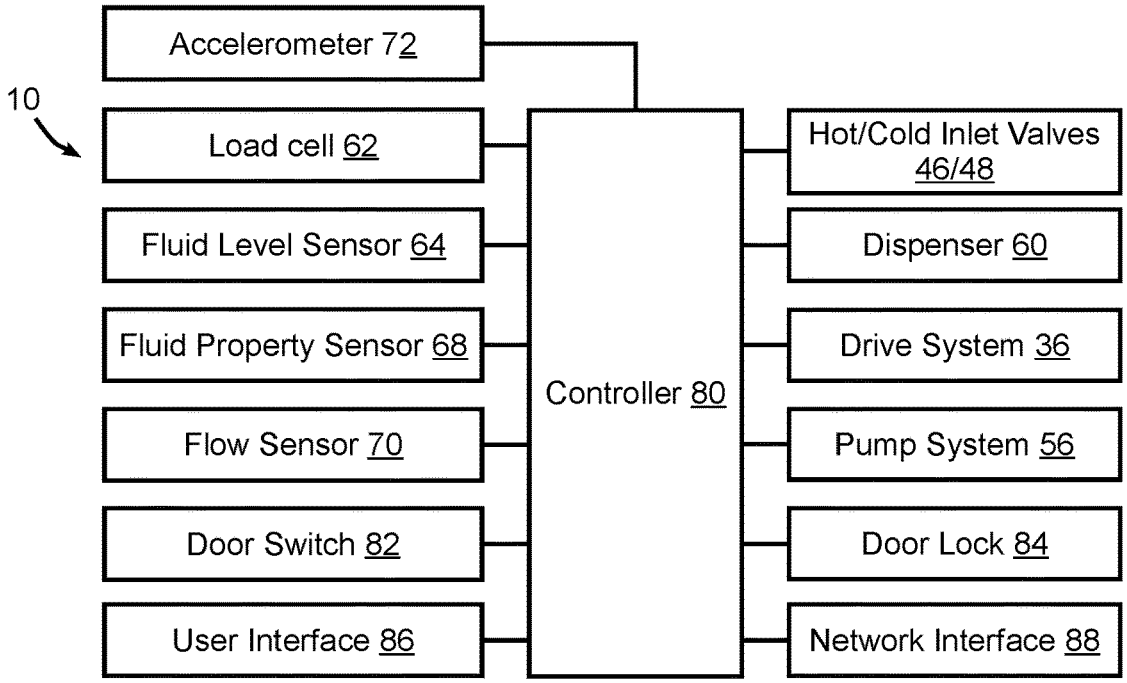
FIG. 5 is a block diagram of an example control system for the laundry washing machine of FIG. 1.

Now turning to FIG. 5, laundry washing machine 10 may be under the control of a controller 80 that receives inputs from a number of components and drives a number of components in response thereto. Controller 80 may, for example, include one or more processors and a memory (not shown) within which may be stored program code for execution by the one or more processors. The memory may be embedded in controller 80, but may also be considered to include volatile and/or non-volatile memories, cache memories, flash memories, programmable read-only memories, read-only memories, etc., as well as memory storage physically located elsewhere from controller 80, e.g., in a mass storage device or on a remote computer interfaced with controller 80.

As shown in FIG. 5, controller 80 may be interfaced with various components, including the aforementioned drive system 36, hot/cold inlet valves 46, 48, pump system 56, load cell 62 (functioning in this embodiment as both a weight sensor and a suspension force sensor), accelerometer 72, fluid flow sensor 64, fluid property sensor 68, and flow sensor 70. In addition, controller 80 may be interfaced with additional components such as a door switch 82 that detects whether door 12 is in an open or closed position and a door lock 84 that selectively locks door 12 in a closed position. Moreover, controller 80 may be coupled to a user interface 86 including various input/output devices such as knobs, dials, sliders, switches, buttons, lights, textual and/or graphics displays, touch screen displays, speakers, image capture devices, microphones, etc. for receiving input from and communicating with a user. In some embodiments, controller 80 may also be coupled to one or more network interfaces 88, e.g., for interfacing with external devices via wired and/or wireless networks such as Ethernet, Bluetooth, NFC, cellular and other suitable networks. Additional components may also be interfaced with controller 80, as will be appreciated by those of ordinary skill having the benefit of the instant disclosure. Moreover, in some embodiments, at least a portion of controller 80 may be implemented externally from a laundry washing machine, e.g., within a mobile device, a cloud computing environment, etc., such that at least a portion of the functionality described herein is implemented within the portion of the controller that is externally implemented.

In some embodiments, controller 80 may operate under the control of an operating system and may execute or otherwise rely upon various computer software applications, components, programs, objects, modules, data structures, etc. In addition, controller 80 may also incorporate hardware logic to implement some or all of the functionality disclosed herein. Further, in some embodiments, the sequences of operations performed by controller 80 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Figure 6:
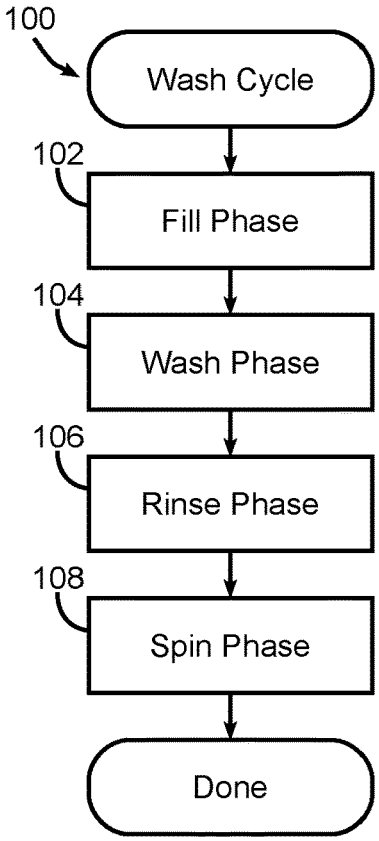
FIG. 6 is a flowchart illustrating an example sequence of operations for implementing a wash cycle in the laundry washing machine of FIG. 1.

Now turning to FIG. 6, and with continuing reference to FIGS. 3 and 5, a sequence of operations 100 for performing a wash cycle in laundry washing machine 10 is illustrated. A typical wash cycle includes multiple phases, including an initial fill phase 102 where the wash tub is initially filled with water, a wash phase 104 where a load that has been placed in the wash tub is washed by agitating the load with a wash liquor formed from the fill water and any wash products added manually or automatically by the washing machine, a rinse phase 106 where the load is rinsed of detergent and/or other wash products (e.g., using a fill rinse where the wash tub is filled with fresh water and the load is agitated and/or a spray rinse where the load is sprayed with fresh water while spinning the load), and a spin phase 108 where the load is spun rapidly while water is drained from the wash tub to reduce the amount of moisture in the load.

It will be appreciated that wash cycles can also vary in a number of respects. For example, additional phases, such as a pre-soak phase, may be included in some wash cycles, and moreover, some phases may be repeated, e.g., including multiple rinse and/or spin phases. Each phase may also have a number of different operational settings that may be varied for different types of loads, e.g., different times or durations, different water temperatures, different agitation speeds or strokes, different rinse operation types, different spin speeds, different water amounts, different wash product amounts, etc.

Figure 7:
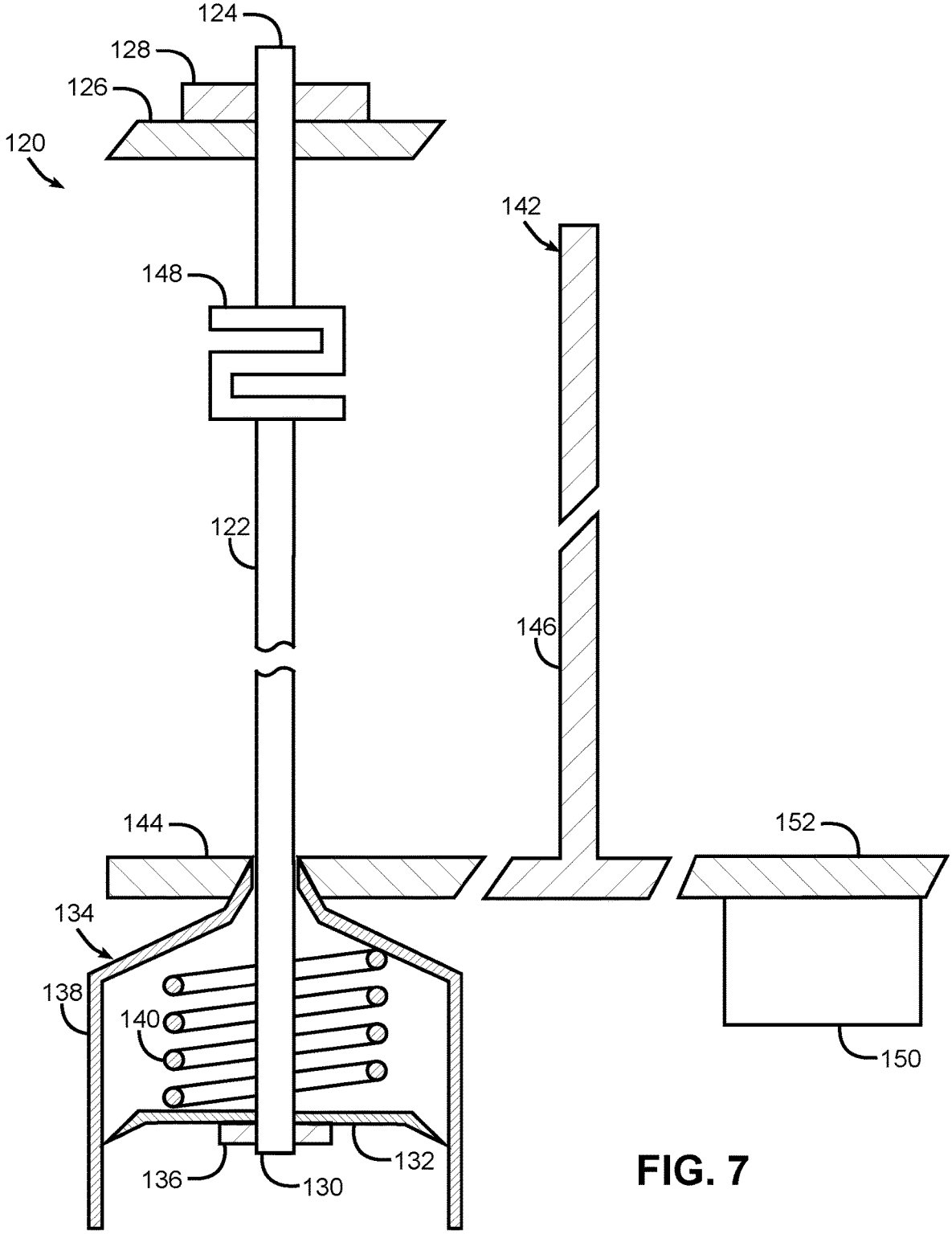
FIG. 7 is a functional vertical section of a portion of the suspension system of the laundry washing machine of FIG. 1.

FIG. 7 next functionally illustrates an example implementation of a portion of a suspension system 120 suitable for use in some embodiments of the invention. In this implementation, suspension system 120 includes a plurality of support members, e.g. four support rods 122 disposed in four corners of a washing machine cabinet, with only a single support rod 122 illustrated in FIG. 7. A first end 124 of support rod 122 may be mounted to a fixed support member 126, e.g., a portion of a housing or cabinet or other supporting structure in a washing machine, and may be retained by a bushing 128 or other vibration-damping interconnection with the supporting structure. In some embodiments, for example, a ball or other flexible support may be used to enable support rod 122 to pivot relative to the supporting structure.

A second end 130 of support rod 122 may be coupled to an end cap 132 of a respective damper 134 (of which additional dampers 134, not shown, may be coupled to other support rods in the suspension system) by a bushing 136 or other vibration-damping interconnection. Damper 134 also includes a cylindrical housing 138 including a circular or other cross-sectional profile matching a cross-section of end cap 132 such that end cap 132 is movable along the longitudinal axis of housing 138. End cap 132 and housing 138 are sized and configured to permit frictional movement of the end cap (and thus the support rod 122) along the longitudinal axis of the housing in much the same manner as a piston. In some embodiments, the end cap 132 may form a seal with the inner surface of housing 138 to restrict the flow of air such that pressure within the sealed portion of the housing further resists movement of the end cap along the longitudinal axis. In some embodiments, one or more springs, e.g., spring 140, may also be disposed within housing 138. It will be appreciated that a multitude of damper designs incorporating air-based, friction-based and/or spring-based damping may be used in various embodiments, so the invention is not limited to the particular damper design illustrated in FIG. 7. It will also be appreciated that components in damper 134 may wear over time, thereby varying the damping characteristics of the damper. For example, the outer edge of end cap 132 and/or the inner surface of housing 138 may wear over time, thereby reducing the friction coefficient and/or reducing the seal formed therebetween. In addition, the spring coefficient of spring 140 may also vary over time.

Housing 138 supports a suspended portion 142 of the washing machine, e.g., a wash tub, such that forces generated by force-generating components during force-generating operations are damped by the suspension system. In the illustrated embodiments, for example, housing 138 is supported on a flange or mount 144 of a wash tub 146, although it will be appreciated that other structure, e.g., a frame, may be used to support a wash tub in other embodiments.

To support the herein-described dynamic damping force optimization, a suspension force sensor, e.g., a load cell 148, is coupled to suspension system 120 to sense force along the support rod 122. In particular, in this embodiment support rod is formed from two sections with a load cell 148 coupled in tension intermediate the first and second ends 124, 130 such that tension forces may be sensed with the load cell. In other embodiments, compression forces may be sensed in lieu of or in addition to tension forces, with a load cell or other sensor coupled to sense compression rather than tension in a support rod. Other configurations, locations, numbers or sensor types may be used to implement a suspension force sensor in other embodiments, and will be apparent to those of ordinary skill having the benefit of the instant disclosure.

In addition, an accelerometer 150 may be coupled to suspended portion 142, e.g., on an underside of a tub bottom 152, and configured to sense acceleration of the suspended portion in one or more directions. In some embodiments, for example, a multi-axis accelerometer, e.g., a two axis accelerometer sensing both horizontal and vertical movement acceleration, may be used, although the invention is not so limited. Other configurations, locations, numbers or sensor types may be used to implement an accelerometer in other embodiments, and will be apparent to those of ordinary skill having the benefit of the instant disclosure.

Figure 8:
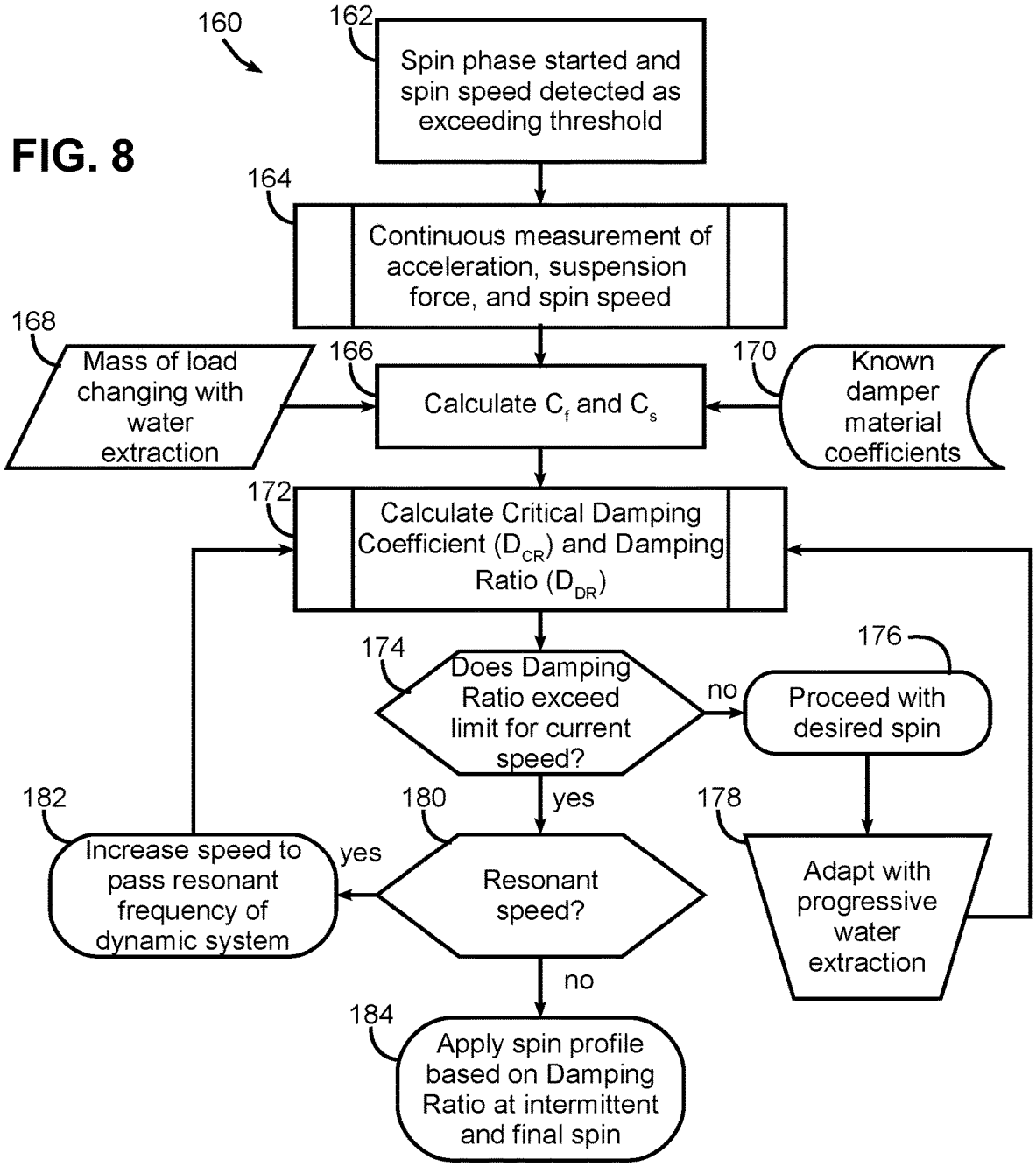
FIG. 8 is a flowchart illustrating an example sequence of operations for implementing dynamic damping force optimization in the laundry washing machine of FIG. 1.

Now turning to FIG. 8, an example sequence of operations 160 is illustrated for dynamically optimizing a spin operation based upon dynamic damping force optimization consistent with some embodiments of the invention. Sequence of operations 160 may be performed by controller 80, and may, in some embodiments, be implemented using program code executable by one or more processors. It is assumed for the purposes of this embodiment that the damper(s) used in the suspension system do not include springs, although adaptation of the calculations below to account for the inclusion of springs would be within the abilities of one of ordinary skill having the benefit of the instant disclosure.

In this embodiment, a damping capability may be dynamically calculated and used to manage a spin operation, e.g., by controlling a spin speed, i.e., the rate at which drive system 36 rotates wash basket 34 during the spin phase of a wash cycle. The damping capability in this embodiment is referred to as a damping ratio $D_{DR}$. The calculation of the damping ratio may be based upon, for example, a ratio between a suspension coefficient ($C_S$) and a critical damping coefficient ($D_{CR}$), as follows:

$$D_{DR} = \frac{C_S}{D_{CR}} \tag{1}$$

The suspension coefficient may be calculated as follows:

$$C_S = 2\sqrt{C_F \times M} \tag{2}$$

where M is mass and is calculated via Newton's Second Law as the product of Force (F) and Acceleration (a), and where $C_F$ is a kinetic friction coefficient calculated as follows:

$$C_F = F \times \mu_k \tag{3}$$

where $\mu_k$ is the coefficient of friction for the damper material (e.g., plastic).

The critical damping coefficient may be determined as follows:

$$D_{CR} = 2\sqrt{C_S \times M} \tag{4}$$

Force (F) and acceleration (a) may be sensed by load cell 62 or 148 and accelerometer 72 or 150, and thus a damping ratio, representative of the current damping capacity of the suspension system, may be calculated from the suspension force and acceleration sensed by the aforementioned sensors. In addition, in some embodiments, calibration may be performed during manufacture, e.g., during end of line testing with an empty tub, and both load cells and accelerometers may be calibrated at their manufacture, with their respective response curves used in the program code for controller 80.

Now with reference to FIG. 8, sequence of operations 160 begins in block 162 where the spin phase of a wash cycle has started, and the spin speed of the wash basket is detected as exceeding a threshold that indicates that the basket is spinning. As indicated in block 164, at this time continuous or repeated measurement of acceleration, suspension force and spin speed is performed, using the outputs of load cell 62 or 148, accelerometer 72 or 150, and a speed sensor configured to sense the rotational speed of wash basket 34, e.g., as may be integrated into drive system 36.

Next, in block 166, the kinetic friction coefficient $C_F$ and the suspension coefficient $C_S$ are calculated as discussed above in connection with Eqs. (2) and (3). As represented by block 168, the mass of the load will change over time as water is extracted from the load during the spin operation. Further, as represented by block 170, the known coefficients of friction of the relevant materials used in the damper and may be used in the calculation of the kinetic friction coefficient.

Block 172 next calculates the critical damping coefficient $D_{CR}$ and the damping ratio $D_{DR}$, using Eqs. (4) and (1), respectively. Block 174 then determines whether the damping ratio, representing the current damping capability of the suspension system, exceeds a limit for the current speed of the wash basket. In particular, a speed-varying limit may be used in some embodiments, e.g., based upon a continuous function, a look-up table or other representation, and it will be appreciated that the limit may be determined empirically in some embodiments.

If the damping ratio does not exceed the limit, control passes to block 176 to proceed with a desired spin operation, and as illustrated in block 178, the speed of the spin operation may be controlled and adapted as water is progressively extracted from the load (and thus as mass decreases). On the other hand, if the limit is exceeded, block 174 passes control to block 180 to determine whether the current speed is causing resonant and harmonic oscillations and/or excessive displacement of the suspended module of the appliance, based upon modal analysis and determined allowed movement inside of the appliance housing, as well as known damping capability at different conditions of loads, speeds, etc. If so, control passes to block 182 to increase the speed beyond the resonant frequency. If not, control passes to block 184 to apply a spin profile based on the damping ratio at any spin of the drum.

Various modifications may be made without departing from the spirit and scope of the invention. For example, additional out of balance sensing may be performed in some embodiments, e.g., based on drive system motor torque or in other manners that will be appreciated by those of ordinary skill having the benefit of the instant disclosure.

Various additional modifications may be made to the illustrated embodiments consistent with the invention. Therefore, the invention lies in the claims hereinafter appended.

What is claimed is:

1. A method of operating a laundry washing machine of the type including a wash tub disposed within a housing and a suspension system supporting the wash tub within the housing and configured to damp forces generated during a force-generating operation during a wash cycle, the method comprising:

with a suspension force sensor coupled to the suspension system, sensing a force applied to the suspension system during the force-generating operation;

with an accelerometer, sensing acceleration of the wash tub during the force-generating operation; and using the force sensed during the force-generating operation and the acceleration sensed during the force-generating operation, dynamically calculating a damping capability of the suspension system and controlling the force-generating operation to maintain damping in the suspension system within the dynamically calculated damping capability of the suspension system.

2. The method of claim 1, wherein the suspension force sensor includes a load cell, and wherein sensing the force includes sensing a tension force in the suspension system.

3. The method of claim 2, wherein the suspension system includes a plurality of support members supporting the wash tub, wherein the load cell is configured to sense a tension force in at least one of the plurality of support members.

4. The method of claim 3, wherein each support member includes a support rod, and wherein the load cell is coupled intermediate first and second ends of a first support rod among the plurality of support rods.

5. The method of claim 1, wherein the accelerometer is coupled to the wash tub, and wherein the accelerometer is a multi-axis accelerometer, and wherein sensing acceleration includes sensing acceleration in two or more directions.

6. The method of claim 1, wherein dynamically calculating the damping capability includes calculating a damping ratio between a suspension coefficient and a critical damping coefficient, wherein the suspension coefficient is based upon a coefficient of friction for a damper in the suspension system, and the critical damping coefficient is based upon the suspension coefficient.

7. The method of claim 1, wherein the force-generating operation comprises a spin operation, the method further comprising dynamically varying a spin speed during the spin operation based upon the calculated damping capability.

8. The method of claim 7, wherein dynamically calculating the damping capability of the suspension system and controlling the force-generating operation to maintain damping in the suspension system within the dynamically calculated damping capability of the suspension system are performed by a controller of the laundry washing machine, and wherein the controller is further configured to detect resonant oscillation and dynamically vary the spin speed to avoid the resonant oscillation.

9. The method of claim 7, wherein controlling the force-generating operation to maintain damping in the suspension system within the dynamically calculated damping capability of the suspension system includes determining whether the calculated damping capability exceeds a limit.

10. The method of claim 9, wherein the limit is a speed-varying limit that varies with a current spin speed.

11. The method of claim 10, further comprising determining the speed-varying limit based upon a continuous function.

12. The method of claim 10, further comprising determining the speed-varying limit based upon a look-up table.

* * * * *